United States Patent [19]

Hatsuo

[11] Patent Number: 4,905,488

[45] Date of Patent: Mar. 6, 1990

[54] DIAL LOCK

[75] Inventor: Nakai Hatsuo, Toyonaka, Japan

[73] Assignee: Clover Co. Ltd., Osaka, Japan

[21] Appl. No.: 215,584

[22] Filed: Jul. 6, 1988

[30] Foreign Application Priority Data

Apr. 19, 1988 [JP] Japan ..... 63-96459

[51] Int. Cl.[4] ..... E05B 37/02

[52] U.S. Cl. ..... 70/312; 70/308; 70/316

[58] Field of Search ..... 70/119, 304, 306, 308–311, 70/312–315, 316–318

[56] References Cited

U.S. PATENT DOCUMENTS

| | | | |
|---|---|---|---|
| 1,078,120 | 11/1913 | Ziehler | 70/306 |
| 1,200,709 | 10/1916 | Clendenny | 70/306 |
| 1,579,046 | 3/1926 | Wildrick | 70/312 X |
| 2,640,344 | 6/1953 | Margo | 70/306 X |
| 3,462,984 | 8/1969 | Soler Marti et al. | 70/310 |
| 3,633,388 | 1/1972 | Atkinson | 70/312 X |
| 4,048,821 | 9/1977 | Bako et al. | 70/314 X |
| 4,343,165 | 8/1982 | Bako | 70/312 |
| 4,602,491 | 7/1986 | Mauer | 70/306 X |
| 4,610,152 | 9/1986 | Duringer | 70/317 X |
| 4,754,623 | 7/1988 | Hwang | 70/312 X |

*Primary Examiner*—Gary L. Smith
*Assistant Examiner*—Suzanne L. Dino
*Attorney, Agent, or Firm*—David G. Conlin; Robert M. Asher

[57] ABSTRACT

A dial lock comprises: a slide bar (10) which is controlled of its movement by engagement with a lock pin (2), dials (3) for controlling movement of the lock pin (2) with respective optional retrieving number, return-to-zero gears (6) to return the dials (3) to these zero-indicating positions at the time of locking and unlocking, and anti-locking means for enabling the locking only after a case when at least one of the dials is set to indicate a number other than zero, whereby optional unlocking number can be set without fail in locking operation.

4 Claims, 13 Drawing Sheets

DIAL LOCK

FIELD OF THE INVENTION AND RELATED ART STATEMENT

1. Field of the Invention

The present invention relates to a dial lock which does not require a key for locking and unlocking and, in particular, to a dial lock which permits setting of an optional number for unlocking by a layman user.

2. Description of the Related Art

Recently, dial locks capable of being locked and unlocked without use of key have been widely used for lockers and safes in sports facilities.

Conventional mechanical dial locks are classified into two types, one that has an unreplaceable specific number for unlocking and the other with a number that can be replaced by operating the mechanism of the lock. Further, electric dial locks have been put into use these days.

Such conventional dial, locks have the following problems. The dial lock having an unreplaceable unlocking number can be unlocked for an unjustifiable purpose by an unauthorized person who has learned the unlocking number. On the other hand, the dial lock having a replaceable unlocking number requires an operation of the internal mechanism with a given pin or lever inserted thereinto, whereby a layman user unfamiliar to the lock mechanics inevitably suffers a difficulty in replacing the unlocking number each time the lock is used.

Further, the electric dial lock allows setting of an optional unlocking number by adapting the electronic circuit to memorize the unlocking number, for example, with the digit key (ten-key) operated. Such lock requires a power source and, therefore, is subject to the problem of the loss of operability or of capability of being unlocked due to the loss of memory in the electronic circuit because of a power stoppage.

OBJECT AND SUMMARY OF THE INVENTION

The present invention provides a purely mechanical dial lock permitting easy setting of an optional unlocking number for the use thereof while eliminating such problems as described above.

The dial lock in accordance with the present invention comprises:

a lock pin having a plurality of projections formed at fixed spatial intervals along the axial direction thereof;

a slider bar having projections and recesses in a fixed configuration at the side thereof abutting on one end of the lock pin, subjected to control over the movement thereof by engagement of the projections and recesses with the lock pin, and serving for opening and closing the door while acting in association with the locking part to lock the door;

dials amounting to the number corresponding to that of projections of the lock pin, each provided with digits numerals on the outer periphery thereof, and each having an internal gear toothed at the inner periphery to be interlocked with an external gear of the below-mentioned dial lock gear so that an optionally fixed code number is set for enabling locking and unlocking;

return-to-zero gears each engaging with the dial for returning the dial to the zero-indicating position;

anti-locking means for retaining the slide bar at a position of unlocking and preventing the door from being locked;

interlocking levers which move in association with the dials through the return-to-zero gears and prevent the locking operation of the slide bar by bringing the anti-locking means into engagement with the slide bar when the slide bar is in an unlocking position and under such condition that all the dials are set zero, and permit a locking operation of the slide bar by bringing the anti-locking means into disengagement from the slide bar when the slide bar is in the locking position under such condition that at least one of the dial is set at a number other than zero;

arms acting in association with the locking and unlocking operations of the slide bar and actuating the return-to-zero gears for returning the dials to the zero-indicating positions at the time of locking and unlocking;

dial lock gears respectively having gates to be in and out of engagement with the projection of the lock pin at the inner periphery thereof and, having peripheral teeth as the external gear on outer periphery thereof, to be in and out of engagement with the internal gear on the inner periphery of the dial, to set an unlocking number of the dial and to control the axial movement of the lock pin, depending on the engagement relation between the gate and the projection of the lock pin as well as between the external gear and the internal gear in the following relation:

(a) at the time of unlocking, the projection fits into the gate and the external gear are out of engagement with the internal gear of the dial, or (b) at the time of locking, the external gear are in engagement with the internal gear of the dial and the projection does not fit into the gate on account of positional deviation therebetween.

For preventing abuse by an unauthorized person, it is possible to make a system to provide slide-bar-latching means for fixing the slide bar in the unlocking position to prevent locking and abuse-preventive means having the slide bar release means for releasing the slide bar from the slide-bar-latching means.

Further, in preparation for opening the door and retrieving the unlocking number when the number has been forgotten by the user, it is possible to use unlocking means capable of opening the locking part of the door while the slide bar is in the locking position. And further, retrieval means having a retrieval pin which can be used only when operated from the inside of the door and fitting into a small hole formed in a fixed position on each dial lock gear at positional agreement of the gate of the dial lock gear with the projection of the lock pin.

When an optional number (called an unlocking number hereinafter) is set with the dials operated in the state of unlocking (before locked) applied according to the present invention, the slide bar becomes ready for locking. Then, the slide bar operates for locking and, with the finish of locking operation, the arm is driven by the slide bar and the dial is returned to the zero-indicating position by the action of the return-to-zero gear. At this time, the lock pin engages with the recess of the slide bar and the projection of the lock pin deviates from the gate of the dial lock gear and abuts on the side of the dial lock gear. As a result, the action of the lock pin is interrupted and, therefore, the slide bar is prevented from operating and the dial lock is kept locked.

On the other hand, if an unlocking number is set with the dial operated on the dial lock that has been locked, the projection of the lock pin positionally agrees with the gate of the dial lock gear, to enable the lock pin to move in the axial direction. Thus, it becomes possible to perform unlocking with the slide bar operated. An unlocking operation at this stage adapts the slide bar to act for unlocking and the slide bar drives the arm so that the dial is returned to the zero-indicating position by the action of the return-to-zero gear. At this time, engagement of the dial with the dial lock gear is cut off and the dial lock is unlocked as it was before used, whereby setting of an optional unlocking number and locking is enabled.

DESCRIPTION OF THE PREFERRED EMBODIMENT

Embodiments of the present invention will be described with reference to the drawings.

Figure 1:
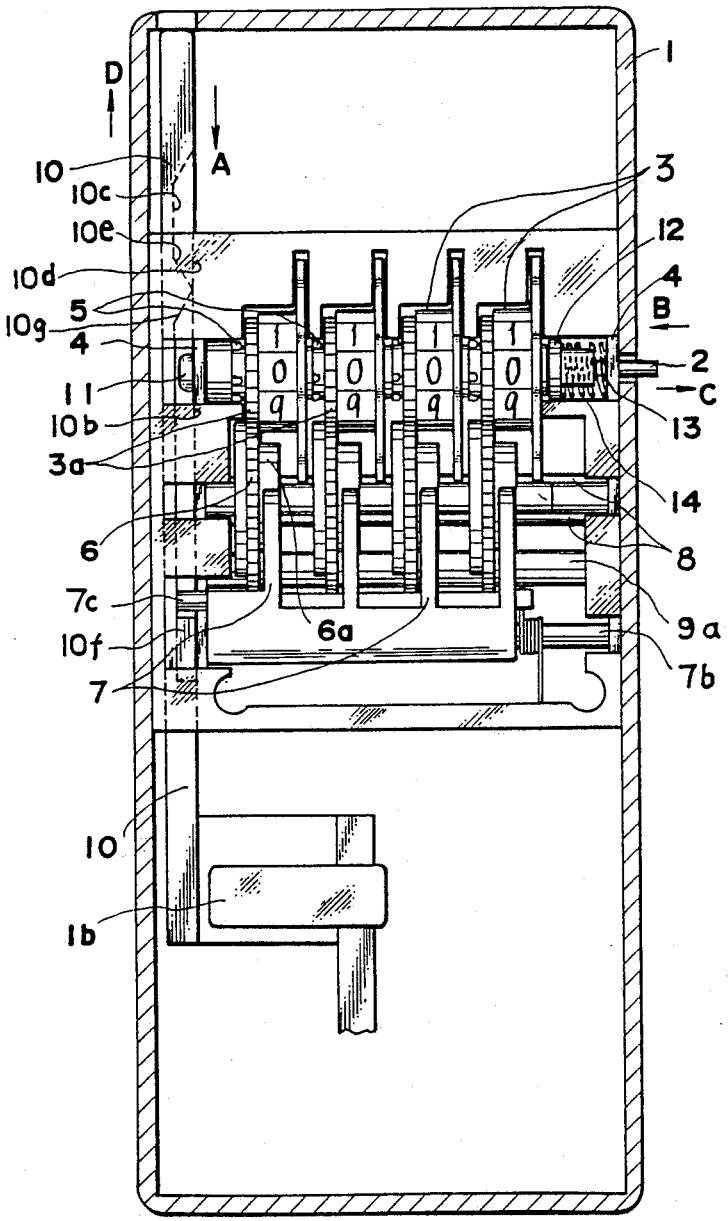
FIG. 1 is a front view of an internal part of a dial lock as an embodiment of the present invention.
Figure 1A:
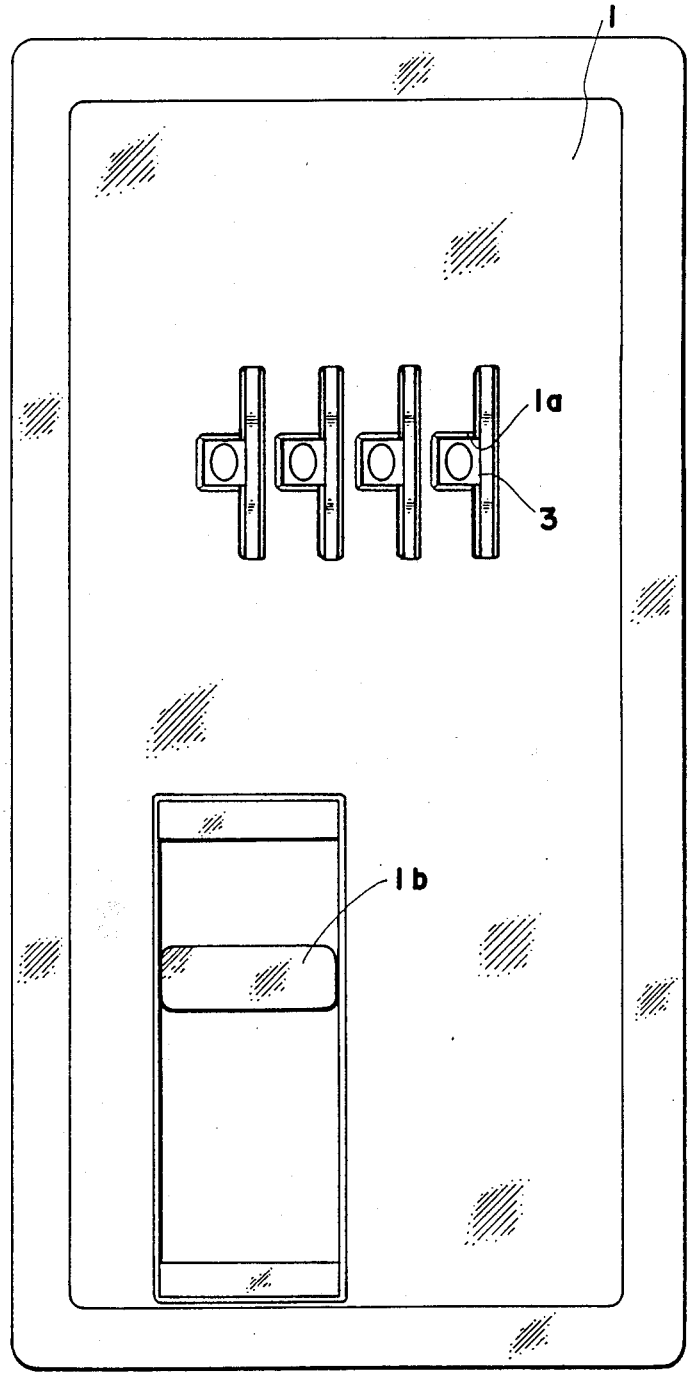
FIG. 1*a* is a front view of an appearance thereof.
Figure 2:
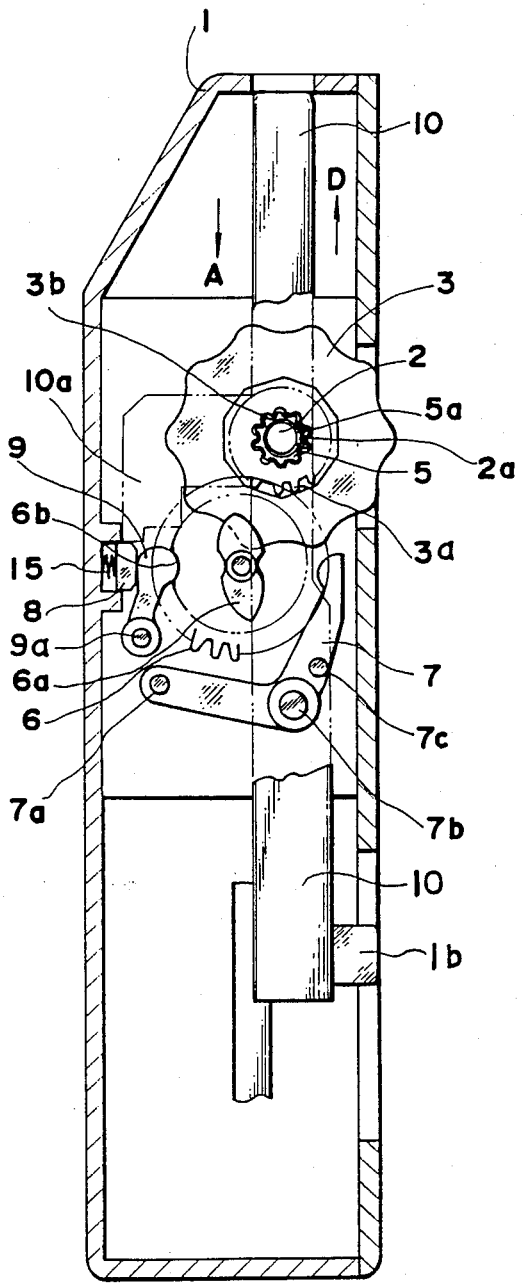
FIG. 2 is a side view of the embodiment shown in FIG. 1.

FIGS. 1 and 2 are a front view and a side view, respectively, of an inner part of the dial lock which has been unlocked. As shown in the drawings, the dial lock contained in the case 1 comprises: a slide bar 10 to control opening/closing of a part to be locked (not shown) in an object to be closed and opened, such as a locker door; a lock pin 2 which is retained by a retentive plate 4 at both ends so as not to rotate freely, and is for controlling the operation of the slide bar 10; plural dials 3 rotatably journaled by the lock pin 2 for setting of locking and unlocking retrieval numbers; and dial lock gears 5 each engaging with the dial 3. The dial lock further comprises plural rotatably journaled return-to-zero gears 6 engaging with gears 3*a* provided on respective dials 3 so as to return these dials 3 to zero-indicating positions, and arms 7 for engaging with heart-shaped cams 6*a* each provided on the side face of the return-to-zero gear 6 for actuating these gears 6. On the side of the return-to-zero gear 6, a cutout 6*b*, which is to be engaged with an interlocking lever 9 when the dial 3 is in the zero-indicating position, is provided. The interlocking levers 9 are journaled by a shaft 9*a* and abut on anti-locking means 8 which controls the movement of the slide bar 10. A first bush 11 and a second bush 12 are provided respectively on respective ends of the lock pin 2. Besides, a first spring 13 for pushing the lock pin 2 leftward (in the direction of arrow B) and a second spring 14 for pushing the dial lock gear 5 leftward (in the direction of arrow B), correspondingly to the movement of the slide bar 10*b*, are provided on one end. FIG. 1*a* is a view of an appearance of this embodiment. Therein, the case 1 has number-windows 1*a*, through which digits on the dials appear, and further has an operation window 1*b* wherein the slide bar 10 is exposed for operation from the outside of the door.

The operation of the embodiment will be described below.

OPERATION FROM UNLOCKING TO LOCKING

As shown in FIGS. 1 and 2, while the dial lock is kept unlocked, the plural dials 3 are all returned to zero-indicating positions as will be described later. At this time, the plural interlocking levers 9 corresponding to the dials 3 engage with the cutouts 6*b* of the return-to-zero gears 6 and, therefore, anti-locking means 8 floats upwards being pushed by the spring 15, abuts on an L-shaped projection 10*a* of the slide bar 10, and prevents the slide bar 10 from moving downward (in the direction of arrow A).

Figure 3:
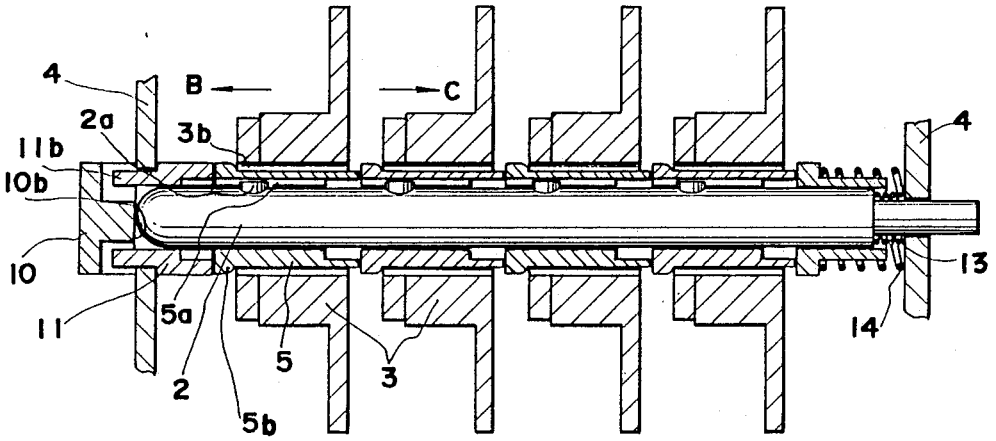
FIG. 3 is a sectional view of a nearby part of the lock pin appearing while the dial lock is kept unlocked.
Figure 8:
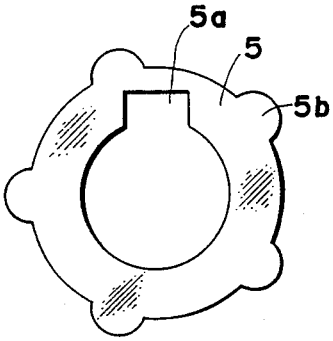
FIG. 8 is a view of a dial lock gear.

As shown in FIG. 3, which is an enlarged view of the vicinity of the lock pin 2, and FIGS. 4 through 7, which are enlarged views of the slide bar 10, the lock pin 2 is pushed rightward (in the direction of arrow C) by the projection 10*b* of the slide bar 10 while the dial lock is kept unlocked. Meanwhile, the dial lock gear 5 is pushed in the direction of arrow B by the 2nd bush 12 energized by the 2nd spring 14, and is in the left position. Accordingly, the projection 2*a* of the lock pin 2 fits into the gate 5*a* formed inside the dial lock gear 5 shown in FIG. 8 and the lock pin 2 engages with the dial lock gear 5. However, since the dial lock gear 5 is pushed leftward (in the direction of arrow B) by the 2nd spring 14, the external gear 5*b* of the dial lock gear 5 are out of engagement with the internal gear 3*b* formed inside the dial 3 to permit the dial 3 to be rotated as desired. Setting of an unlocking number is possible in such a state as above.

Figure 9:
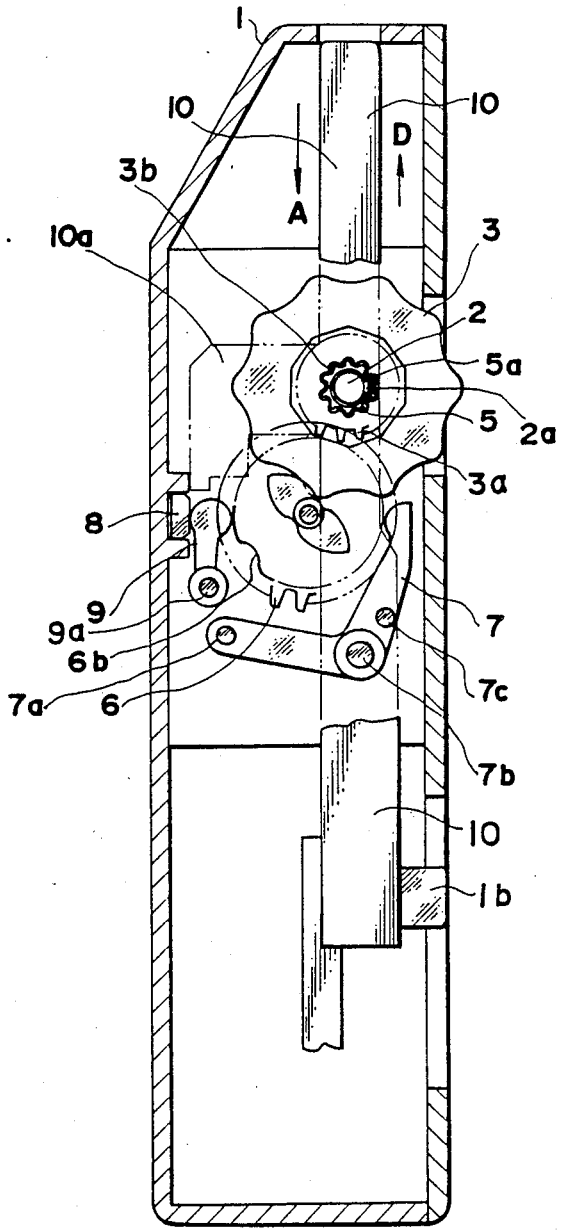
FIGS. 9 and 10 are side views for explaining the operation of the embodiment.
Figure 10:
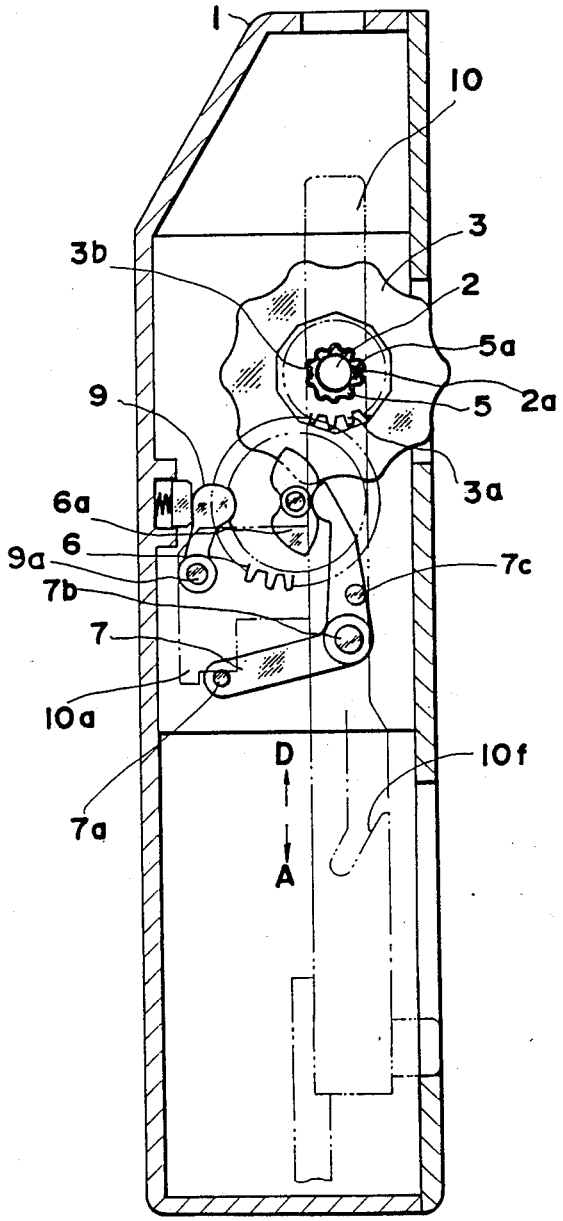
Figure 11:
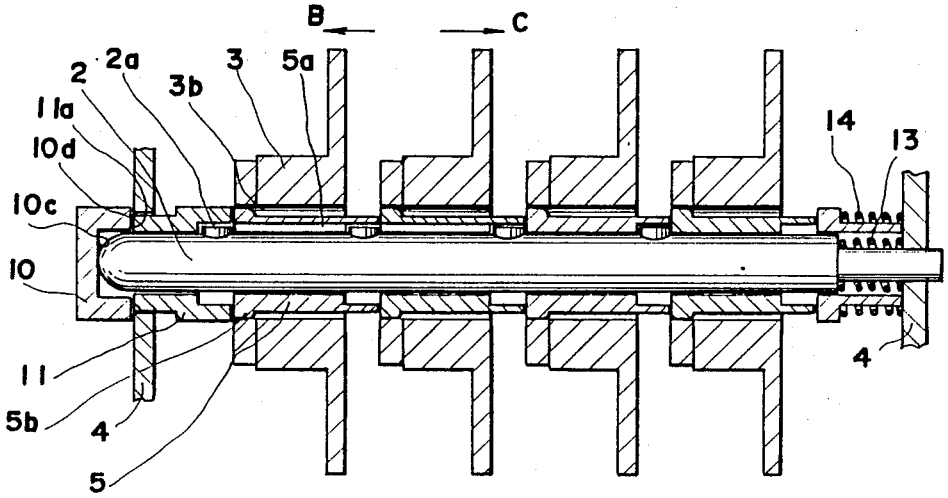
FIG. 11 is a sectional view showing the vicinity of the lock pin appearing while the dial lock is kept locked.

When at least one of the dials 3 is turned to indicate a number other than zero, (setting of an unlocking number), the return-to-zero gear 6 is rotated by the gear 3*a* of the dial 3 and the interlocking lever 9 is disengaged from the cutout 6*b*, whereby anti-locking means 8 is pushed by the interlocking lever 9 and adapted to be out of contact with the L-shaped projection 10*a* of the slide bar 10 (FIG. 9). As a result, the slide bar 10 can be lowered down (in the direction of arrow A). That is, locking can be made only after setting of an unlocking number. When the slide bar 10 is lowered down, the lower end of the L-shaped projection 10*a* presses the pin 7*a* of the arm 7 downwards as shown in FIG. 10 and the arm 7, thereby, turning the arm 7 around the axis 7*b*. And the upper end of the arm 7 presses the heart-shaped cam 6*a*, actuates the return-to-zero gear 6, and returns the dial 3 to the zero-indicating position.

Figure 3A:
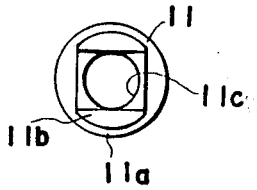
FIGS. 3*a* and 3*b* are a plan and a front view, respectively, of a first bush.
Figure 3B:
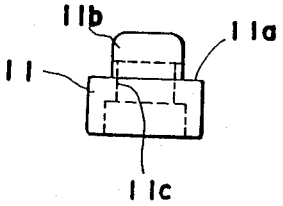
Figure 4:
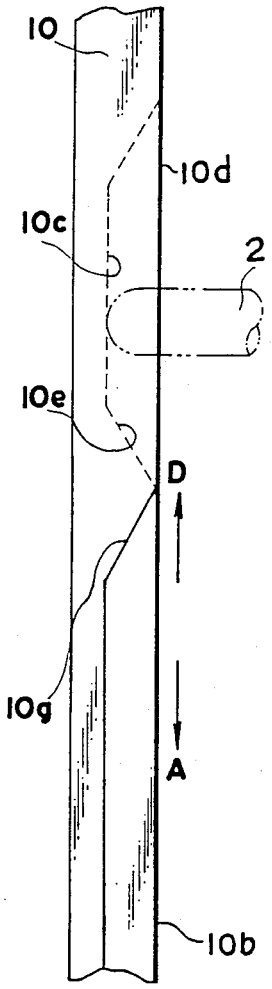
FIGS. 4 and 5 are a side view and a front view, respectively, of the slide bar.
Figure 5:
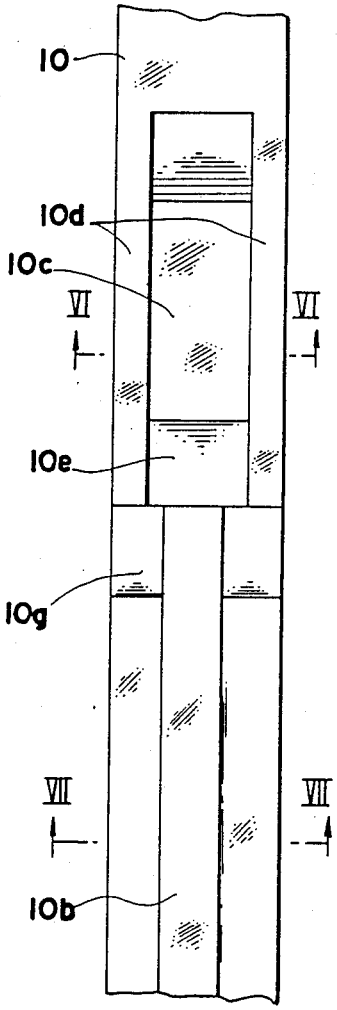
Figure 6:
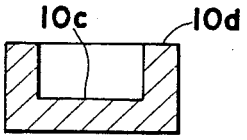
FIGS. 6 and 7 are sectional views taken along the lines VI—VI and VII—VII, respectively, in FIG. 5.
Figure 7:
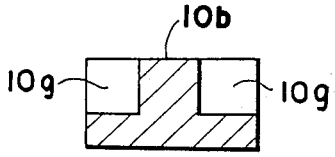

When the slide bar 10 is lowered down as described above, the lock pin 2 fits into the recess 10*c* (see FIG. 4 and FIG. 5) of the slide bar 10, and hence the pin 2 moves leftward by the force of the spring 14 as shown by FIGS. 1, 3 (in the direction of arrow B). On the other hand, a two-forked part 11*b* of the 1st bush 11 as shown in FIGS. 3*a* and 3*b*, which are a plan view and a front view, respectively, is pushed by an oblique face 10*g* and planar faces 10*d*, on both sides of the recess 10*c*, to move the dial lock gear 5 rightward (in the direction of arrow C). Consequently, the external gear 5*b* of the dial lock gear 5 engages with the internal gear 3*b* of the dial 3. On the other hand, the projection 2*a* of the lock pin 2 is detached from the external gear 5*b* of the dial lock gear 5, and hence engagement of the lock pin 2 with the dial lock gear 5 is cut off.

When the dial 3 is returned to the zero-indicating position in such a state as above, the dial lock gear 5 rotates together with the dial 3, and the gate 5*a* deviates from the dial lock pin 2. Therefore, the projection 2*a* of the lock pin 2 strikes the dial lock gear 5 and the lock pin 2 is intercepted of rightward motion (in the direction of arrow C). With the interception of rightward motion of the lock pin 2, the lock pin 2 strikes the oblique face 10*a* of the slide bar 10, if the slide bar 10 is intended to be pushed upward (in the direction of arrow D). In this way, the dial lock is locked.

OPERATION FROM LOCKING TO UNLOCKING

Figure 12:
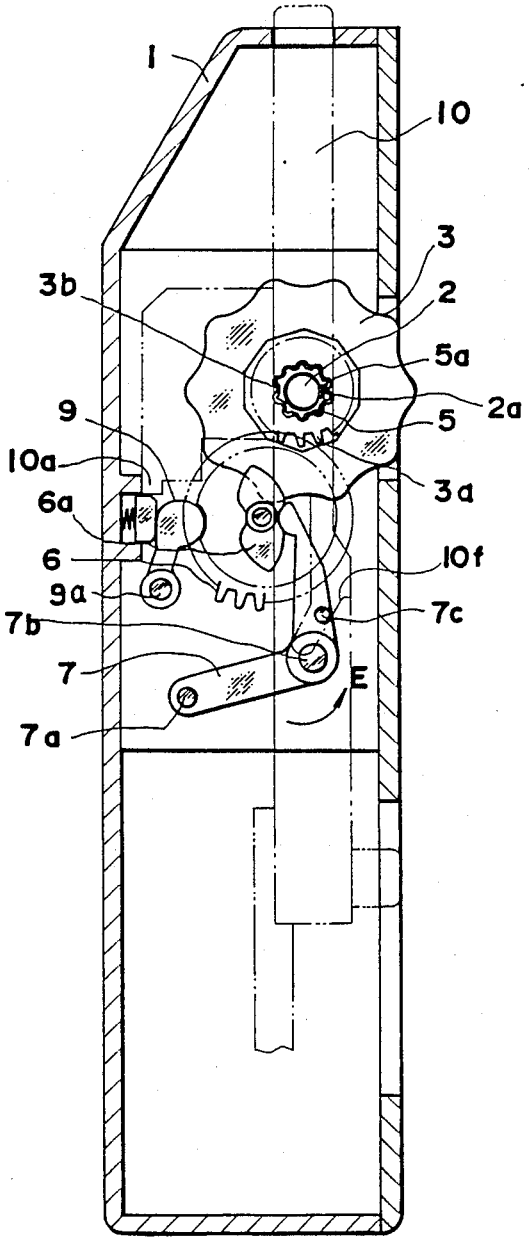
FIG. 12 is a side view for explaining the operation of the embodiment.

The sequential step from locking state to unlocking state will be described. When the dials 3, which have been returned to the zero-indicating position after locked, are operated for setting of an unlocking number, the gate 5*a* of the dial lock gear 5 and the projection 2*a* of the lock pin 2, which have been hitherto deviated from each other are brought into a state of agreement in circumferential angular position. When the slide bar 10 in such a state as above is intended to be pushed upward, the lock pin 2 is pushed by the oblique face 10*e* and planar faces 10*b* of the slide bar 10 to the right side (in the direction of arrow C). As a result of the above-mentioned state of agreement in circumferential angular position, the slide bar 10 can be pushed upward (in the direction of arrow D) (FIG. 3). With the upward thrust of the slide bar 10, a cutout 10*f* of the slide bar engages with the second pin 7*c* of the arm 7 and turns the arm 7 in the direction of arrow E as shown in FIG. 12. At this time, the arm 7 engages with the heart-shaped cam 6*a* of the return-to-zero gear 6, to actuate it thereby returning the dial 3 to the zero-indicating position.

The 1st bush 11, on the other hand, does not abut on the slide bar 10 and moves to a position, at which the stepped part 11*a* thereof abuts on the retention plate 4. The dial lock gear 5 is pressed by the 2nd bush 12 which is urged by the spring 14 and moves leftward (in the direction of arrow B). Consequently, engagement between the dial 3 and the dial lock gear 5 is cut off (FIG. 3).

As has been described above, in the embodiment of the present invention, a locking operation of the slide bar 10 is inhibited until an unlocking number is set, and the dial lock is locked without fail once the slide bar operates for locking. Therefore, there is no fear of making a mistake in the locking operation. And moreover, because of the return of the dials 3 to the zero-indicating position at the time of locking and unlocking, there is no need to change the unlocking number to another number after a locking or an unlocking of the lock, in order to protect the unlocking number from being known by the unauthorized person. Incidentally, in the above-mentioned embodiment, the structure is such that the dials 3 are returned to the zero-indicating position, however, another structure, wherein any other number than zero is used for position indication, may be adopted.

Unlocking by an unauthorized person can effectively be prevented by providing a dummy hole on the side whereat the dial lock gear 5 strikes the projection 2*a* of the lock pin at a locking operation.

Figure 13:
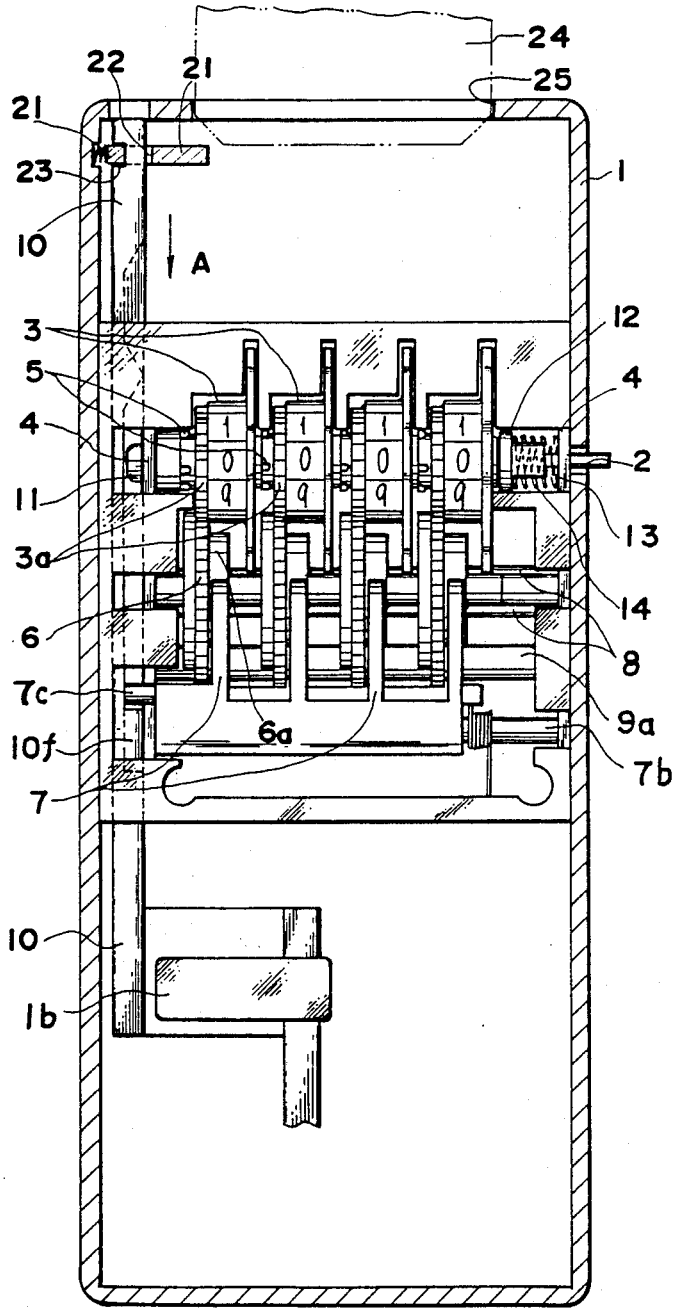
FIGS. 13 and 14 are front views of another embodiment.
Figure 14:
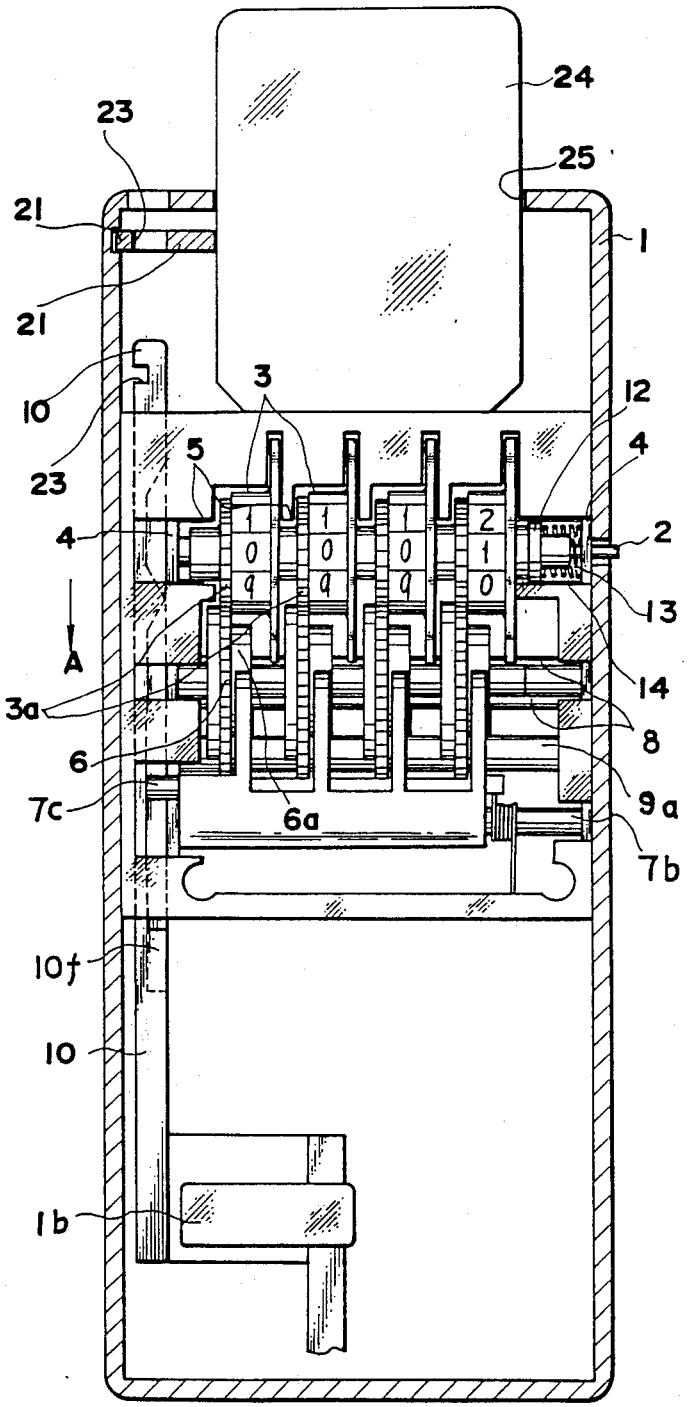

FIGS. 13 and 14 show another embodiment of the present invention. In this embodiment, for prevention of unproper locking by an unauthorized person, provided is unproper locking prevention means (21+24) which comprises a slide bar latching member 21 for fixing the slide bar at a position, wherein the dial lock is unlocked, and a slide bar release member 24 for disengaging the slide bar 10 from the slide bar latching member 21. As shown in FIG. 13, at the time when the card-shaped slide bar release member 24 is inserted into the lock, an edge of an engaging hole 22 of the slide bar latching member 21 engages with the recess 23 of the slide bar, thereby to prevent the slide bar 10 from moving downward (in the direction of arrow A). With the slide bar release member 24 inserted through an insertion aperture 25, the slide bar latching member 21 is pushed by the slide bar release member 24 and hence is moved leftward of the drawing, whereby the slide bar 10 can move downward as shown in FIG. 14. Therefore, only a justified or authorized user having the slide bar release member 24 can lock the dial lock, thereby preventing the abuse. By the configuration that the slide bar release member 24 is inserted into the lock from the inside face of the door and is kept inside of the door during the locked period of the lock, abuse by the unauthorized person of the lock can be prevented.

In addition, by bearing the user's name, a specific number or mark on the slide bar release member 24 and by providing a window for showing such references therethrough, the user can easily find the locker assigned to him.

Figure 15:
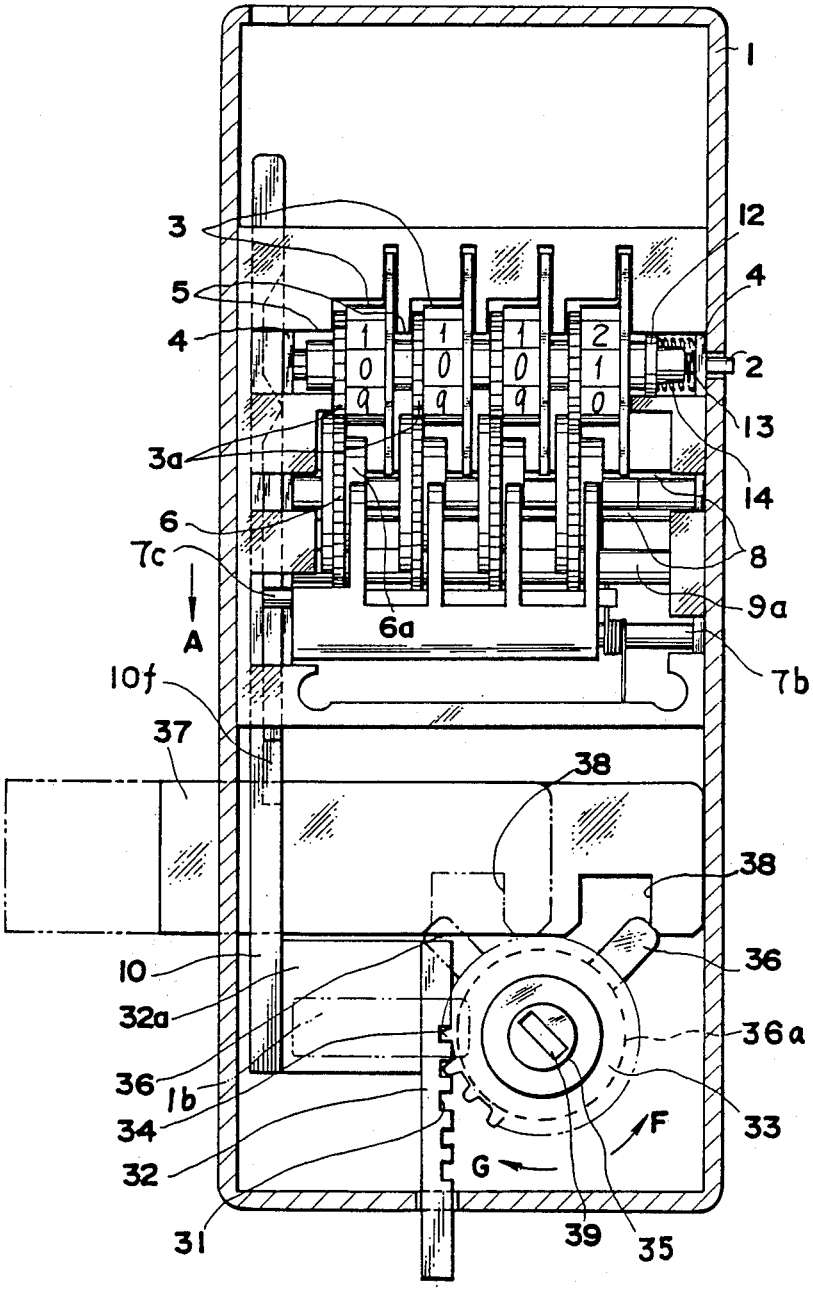
FIGS. 15, 16 and 17 are a front view, bottom plan view and side view, respectively, of still another embodiment.
Figure 16:
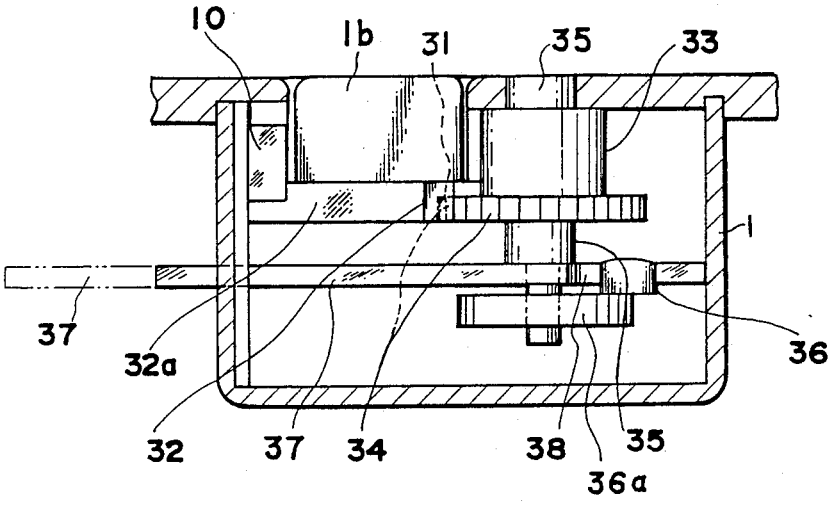
Figure 17:
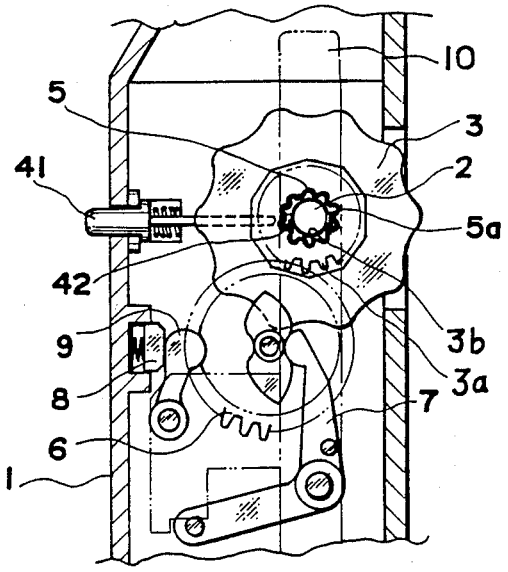

FIGS. 15, 16 and 17 show an embodiment further comprises: unlocking means which permits the user to open the door even when the user has forgotten his unlocking number; and unlocking number retrieval means for retrieving, after opening the door by the above-mentioned unlocking member, the unlocking number that has been set by the user. As shown in FIG. 15, in this embodiment, a cylinder lock is used as unlocking means. The slide bar 10 is connected to a rod 32 having a rack 31 with a connecting member 32*a*. With the downward movement (in the direction of arrow A) of the slide bar 10, the rod 32 moves downward, and the rack 31 engages with a gear 34 on the outer cylinder 33 of the cylinder lock, to rotate the cylinder 33 in the direction of arrow F. An inner cylinder 35 rotates, too, in the direction of arrow F while following the outer cylinder 33 and a projection 36 formed on a disk 36*a* provided on the inner cylinder 35 engages with a recess 38 of a lock bolt 37 to thrust the lock bolt 37 to a locking part (not shown) for closing the door. After the door is thus closed, by inserting a key (not shown) into a key hole 39 of the cylinder lock and turned in the direction of arrow G, the outer cylinder 33 does not rotate, but only the inner cylinder 35 rotates in the direction of arrow G. The projection 36 engages with the recess 38 to pull out the lock bolt 37 from the locking part. As a result, the door is opened in such a state that the slide bar 10 is in the locking position (FIG. 15). In the above-said embodiment, a cylinder lock is used as unlocking means, however, no limit is imposed on the kind of unlocking means and any mechanism may suffice as far as it is capable of opening the door in such a state that the slide bar is fixed.

FIG. 17 shows unlocking number retrieval means. As shown in the drawing, a retrieval pin 41 opposing each of the dial lock gears is provided on the reverse side of the case 1. Each dial lock gear 5 is provided with a small hole 42. The small hole 42 is formed in a position at which the gate 5*a* of the dial lock gear 5 agrees with the projection 2*a* of the lock pin 2, when the small hole engages with the retrieval pin 4*a* and, to enable moving of the lock pin. By pressing the retrieval pin 41 to turn the corresponding dial 3, the retrieval pin 41 stops when engaging with the corresponding small hole 42 coming to a position opposite to the pin. At this time, the unlocking number appears through the number window 1*a* (FIG. 1*a*) and retrieval of the unlocking number is made possible in this way. And then, the slide bar 10 fixed at the locking position can be operated freely, so that the dial lock becomes again available for the usual use after setting of the unlocking number.

Since the dial lock in accordance with the present invention permits setting of an unlocking number by operating the dial only, easy setting and a complete replacement of the unlocking number at each use is possible. Since the structure is made so that the dial is returned to the zero-indicating position when the dial lock is locked by the locking operation of the slide bar, and again is returned to the zero-indicating position when the dial lock is unlocked after setting the unlocking number, a third party or unauthorized person can be prevented from knowing the unlocking number. Moreover, abuse preventive means also prevents the undue use by the third party or unauthorized person.

Furthermore, when the dial lock is provided with unlocking means and unlocking number retrieval means, the door can be opened by unlocking means by use of a master key which is in the custody of the locker manager when the user may have forgotten the unlocking number, and the unlocking number having slipped the user's memory can be retrieved, and thereby the dial lock that has been locked can easily be restored to be unlocked.

Although the invention has been described in its preferred forms with a certain degree of particularity, it is understood that the present disclosure of the preferred forms can be changed in the details of construction and different combinations and arrangements of parts may be restored to without departing from the spirit and the scope of the invention as hereinafter claimed.

What is claimed is:

1. A dial lock comprising:

a lock pin having a plurality of projections formed at fixed spatial intervals along said axial direction thereof;

a slider bar having projections and recesses in a fixed configuration at said side thereof abutting on one end of said lock pin, subjected to control over said movement thereof by engagement of said projections and recesses with said lock pin, and serving for opening and closing a door while acting in association with said locking part to lock said door;

a plurality of dials equal in number to that of projections of said lock pin, each provided with numerals on said outer periphery thereof, and each having an internal gear toothed at said inner periphery to be interlocked with an external gear of the below-mentioned dial lock gear so that an optionally fixed code number is set for enabling locking and unlocking;

return-to-zero gears each engaging with said dial for returning said dial to said zero-indicating position;

anti-locking means for retaining said slide bar at a position of unlocking and preventing said door from being locked;

interlocking levers which are to move in association with said dials through said return-to-zero gears and prevent said locking operation of said slide bar by brining said anti-locking means into engagement with said slide bar when said slide bar is in an unlocking position and under such condition that all said dials are set zero, and permit a locking operation of said slide bar by brining said anti-locking means into disengagement from said slide bar when said slide bar is in said locking position under such condition that at least one of said dial is set at a number other than zero;

arms acting in association with said locking and unlocking operations of said slide bar and actuating said return-to-zero gears for returning said dials to said zero-indicating positions at said time of locking and unlocking;

dial lock gears respectively having gates to be in and out of engagement with said projection of said lock pin at said inner periphery thereof and, having peripheral teeth as said external gear on outer periphery thereof, to be in and out of engagement with said internal gear on said inner periphery of said dial, to set an unlocking number of said dial and to control said axial movement of said lock pin, depending on said engagement relation between said gate and said projection of said lock pin as well as between said external gear and said internal gear in the following relation:

(a) at the time of unlocking, said projection fits into said gate and said external gear is out of engagement with said internal gear of said dial, or (b) at the time of locking, said external gear is in engagement with said internal gear of said dial and said projection does not fit into said gate on account of positional deviation therebetween.

2. A dial lock in accordance with claim 1, which further comprises slide bar latching means for latching said slide bar at said unlocking position and slide bar release means for disengaging said slide bar from slide bar latching means to enable a locking operation of said slide bar.

3. A dial lock in accordance with claim 1, which further comprises unlocking means to open said locking part of said closed door without actuating said slide bar, and a retrieval pin which is inserted into a small hole formed in a fixed position on each dial lock gear when said gate of said dial lock gear positionally agrees with said projection of said lock pin and is operable only when operated from said inside of said door.

4. A dial lock in accordance with claim 2, which further comprises unlocking means to open said locking part of said closed door without actuating said slide bar (10), and a retrieval pin (41) which is inserted into a small hole (42) formed in a fixed position on each dial lock gear (5) when said gate (5*a*) of said dial lock gear positionally agrees with said projection (2*a*) of said lock pin (2) and is operable only when operated from said inside of said door.

* * * * *